US006209901B1

(12) United States Patent
Patel

(10) Patent No.: US 6,209,901 B1
(45) Date of Patent: Apr. 3, 2001

(54) WHEEL CHAIR WITH WASTE ELIMINATION OPENING

(76) Inventor: Arvind Patel, 1531 W. Laurel Ave., Eunice, LA (US) 70535

( * ) Notice: Subject to any disclaimer, the term of this patent is extended or adjusted under 35 U.S.C. 154(b) by 0 days.

(21) Appl. No.: 09/337,691

(22) Filed: Jun. 22, 1999

(51) Int. Cl.[7] ..... A61G 5/10
(52) U.S. Cl. ..... 280/304.1; 297/188.09
(58) Field of Search ..... 280/250.1, 304.1; 297/DIG. 4, 188.08, 188.09, 218.3, 228.11; 5/604; 414/921; 180/907; 150/154, 166

(56) References Cited

U.S. PATENT DOCUMENTS

| | | | | |
|---|---|---|---|---|
| 3,654,643 | * | 4/1972 | Clanan | 5/81 B |
| 3,936,890 | * | 2/1976 | Oberstein | 4/112 |
| 4,067,409 | * | 1/1978 | DiMatteo et al. | 180/6.5 |
| 4,170,368 | * | 10/1979 | Southward et al. | 280/242 WC |
| 4,547,014 | * | 10/1985 | Wicker | 296/100 |
| 4,713,848 | * | 12/1987 | Domovs et al. | 4/480 |
| 4,888,833 | | 12/1989 | Garcia et al. | 280/304.1 |
| 4,955,624 | | 9/1990 | Jeun-long | 280/42 |
| 5,060,960 | | 10/1991 | Branscumb et al. | 280/250.1 |
| 5,255,934 | * | 10/1993 | Wilson | 280/657 |
| 5,568,933 | | 10/1996 | Mizuno | 280/42 |
| 5,577,753 | | 11/1996 | Pociask | 280/250.1 |
| 5,586,343 | | 12/1996 | Mayle | 4/480 |
| 5,860,664 | * | 1/1999 | Smith | 280/250.1 |

FOREIGN PATENT DOCUMENTS 11-9625 * 1/1999 (JP) .

* cited by examiner

*Primary Examiner*—Paul N. Dickson
*Assistant Examiner*—Avraham H. Lerner
(74) *Attorney, Agent, or Firm*—Joseph N. Breaux

(57) ABSTRACT

A wheel chair with a waste elimination opening provided in the seat of the wheel chair and that included a frame sized and configured to back over the bowl of a commode to allow the individual to handle his/her waste disposal privately and with dignity. A cover is provided for covering the waste elimination opening when it is not needed.

1 Claim, 2 Drawing Sheets

WHEEL CHAIR WITH WASTE ELIMINATION OPENING

TECHNICAL FIELD

The present invention relates to wheel chairs and more particularly to a wheel chair with a waste elimination opening that includes an open configuration raised wheel chair support frame positionable over a commode bowl, an elevated sling seat section supported on the raised support frame having a waste elimination opening formed therethrough, and an accordion fold elimination opening cover having a pair of sliding levers coupled thereto to allow the elimination opening cover to slide between a withdrawn position allowing waste to pass through the waste elimination opening and an extended position blocking the waste elimination opening and providing support to the buttocks area of the user; the open configuration raised support frame being sized to allow the elevated sling seat of the wheel chair to be positioned over the bowl of a commode.

BACKGROUND ART

Many wheel chair bound individuals would be capable of using the commode without assistance if provided with the proper wheel chair construction. It would be desirable, therefore, to increase the quality of life of these individuals to have a wheel chair with a waste elimination opening provided in the seat of the wheel chair and that included a frame sized and configured to back over the bowl of a commode to allow the individual to handle his/her waste disposal privately and with dignity.

GENERAL SUMMARY DISCUSSION OF INVENTION

It is thus an object of the invention to provide a wheel chair with waste elimination opening that includes an open configuration raised wheel chair support frame positionable over a commode bowl, an elevated sling seat section supported on the raised support frame having a waste elimination opening formed therethrough, and an accordion fold elimination opening cover having a pair of sliding levers coupled thereto to allow the elimination opening cover to slide between a withdrawn position allowing waste to pass through the waste elimination opening and an extended position blocking the waste elimination opening and providing support to the buttocks area of the user; the open configuration raised support frame being sized to allow the elevated sling seat of the wheel chair to be positioned over the bowl of a commode.

Accordingly, a wheel chair with waste elimination opening is provided. The wheel chair with waste elimination opening includes an open configuration raised wheel chair support frame positionable over a commode bowl, an elevated sling seat section supported on the raised support frame having a waste elimination opening formed therethrough, and an accordion fold elimination opening cover slidable between a withdrawn position allowing waste to pass through the waste elimination opening and an extended position blocking the waste elimination opening and providing support to the buttocks area of the user; the open configuration raised support frame being sized to allow the elevated sling seat of the wheel chair to be positioned over the bowl of a commode. The wheel chair support frame includes wheels, a back rest, arm rests and foot rests; and preferably includes a lift mechanism for lifting the frame to accommodate extra high commode bowls often found in public rest room facilities, an adjustable angle back rest for comfort, and a brake mechanism for holding the wheels of the wheel chair in a fixed position while using the commode. In addition, while the accordion fold elimination opening cover can be manually operated, it is also desirable in some instances to provide a powered cover opening and closing mechanism.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
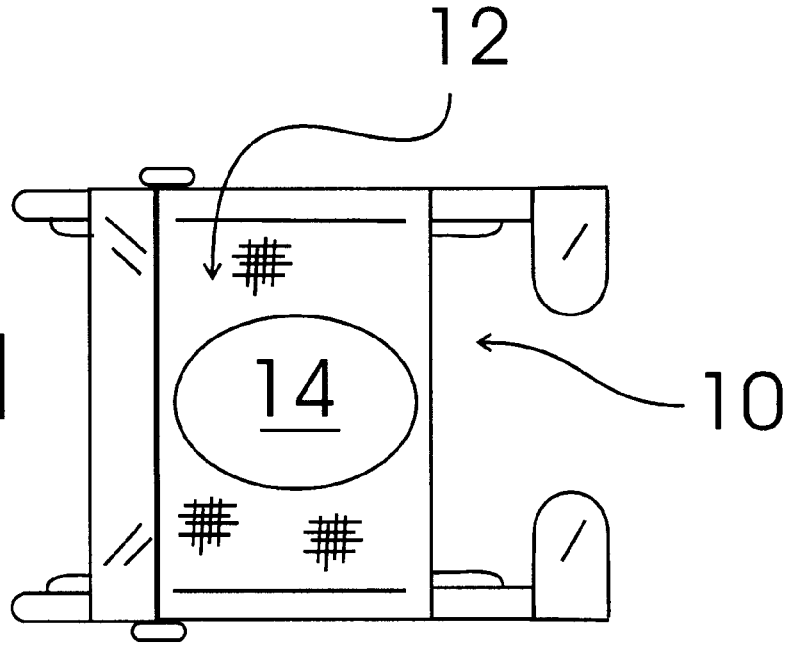
FIG. 1 is a top plan view of an exemplary embodiment of the wheel chair of the present invention showing the elevated sling seat section with the waste elimination opening, the two elimination opening cover levers in the withdrawn position, and the open configuration support frame.
Figure 2:
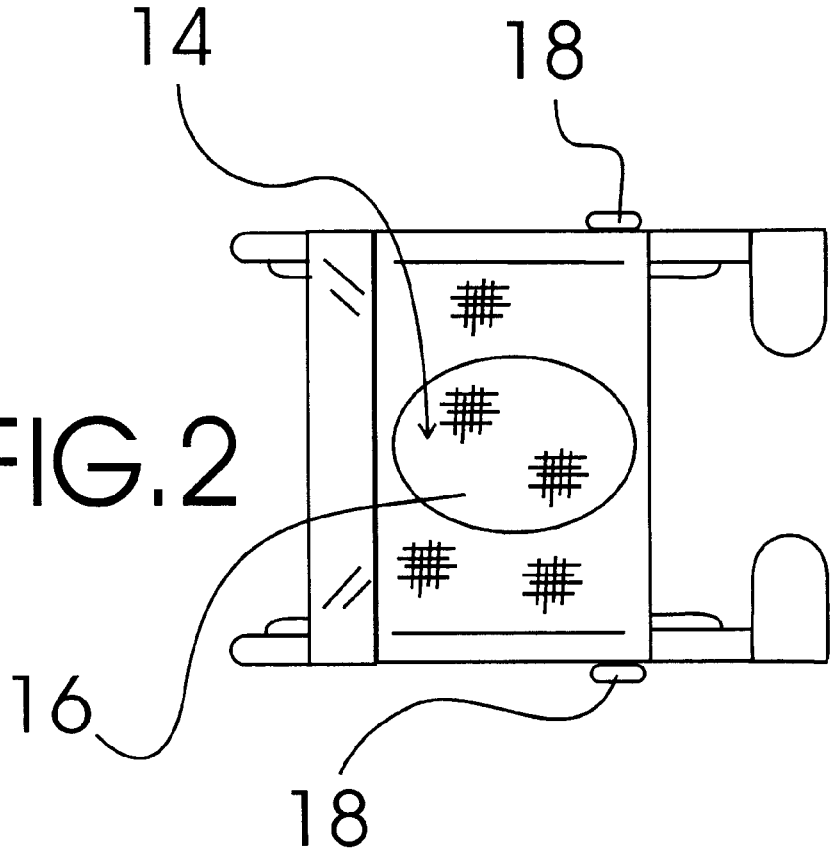
FIG. 2 is a top plan view of an exemplary embodiment of the wheel chair of the present invention showing the sling seat section with the waste elimination opening covered by the elimination opening cover and the two elimination cover levers in the fully forward position.

FIG. 1 shows an exemplary embodiment of the wheel chair of the present invention, generally designated 10, from the top to show the show the elevated sling seat section, generally designated 12, with the oval waste elimination opening 14. Referring to FIG. 2, oval waste elimination opening 14 is coverable by an accordion fold elimination opening cover 16 that is positioned from a retracted position (shown in FIG. 1) to an extended position by moving the two elimination cover levers 18 reward or forward as required.

Figure 3:
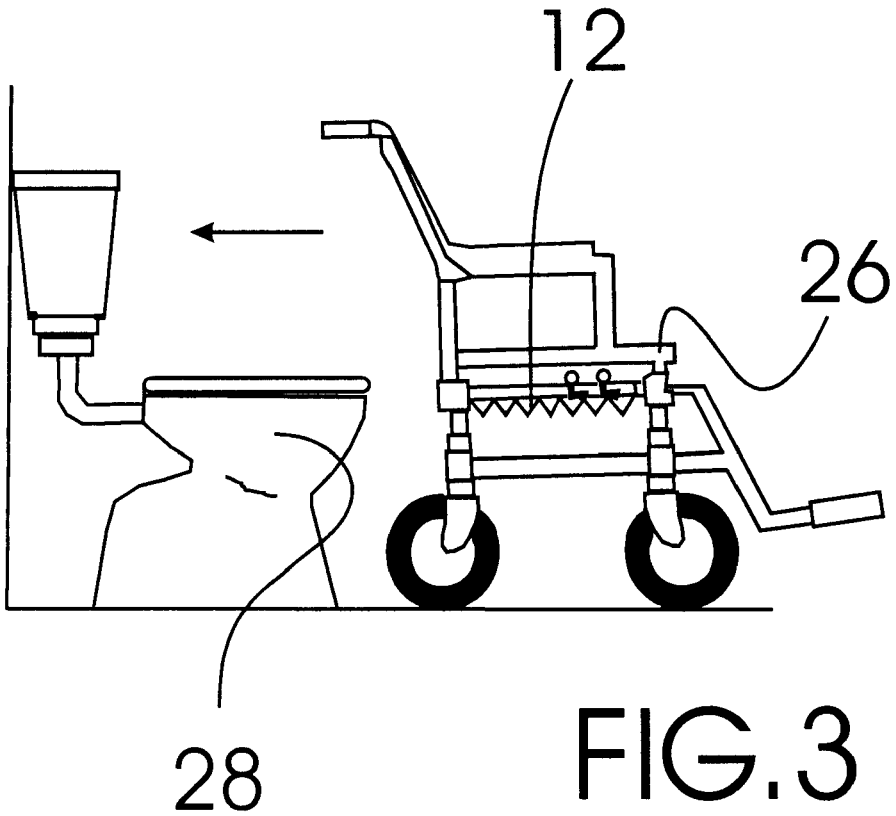
FIG. 3 is a side plan view showing the exemplary wheel chair of FIG. 1 with the elimination opening cover in the forward position and the elevated wheel chair chassis in position in front of a conventional commode bowl prior to rolling the wheel chair backward to position the waste elimination opening over the commode bowl opening for use.
Figure 4:
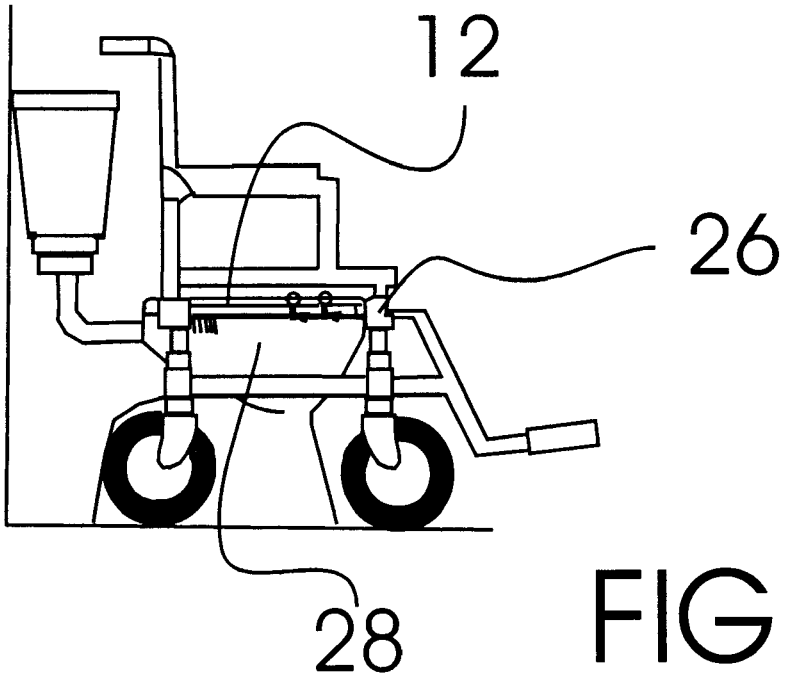
FIG. 4 is a side plan view showing the exemplary wheel chair of FIG. 1 with the elimination opening cover in the rearward position and the elevated wheel chair chassis positioned with the waste elimination opening of the sling seat positioned over the commode bowl opening.

Referring to FIGS. 3 and 4, elevated sling seat section 12 is supported on an oversized open configuration raised wheel chair support frame 26 that is open between the wheels so as to be positionable over a commode bowl 28 to allow the user to use the commode in privacy and dignity.

It can be seen from the preceding description that a wheel chair with waste elimination opening has been provided that includes an open configuration raised wheel chair support frame positionable over a commode bowl, an elevated sling seat section supported on the raised support frame having a waste elimination opening formed therethrough, and an accordion fold elimination opening cover slidable between a withdrawn position allowing waste to pass through the waste elimination opening and an extended position blocking the waste elimination opening and providing support to the buttocks area of the user; the open configuration raised support frame being sized to allow the elevated sling seat of the wheel chair to be positioned over the bowl of a commode.

It is noted that the embodiment of the wheel chair with waste elimination opening described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A wheel chair with waste elimination opening comprising:

an open configuration raised wheel chair support frame positionable over a commode bowl;

an elevated sling seat section supported on the raised support frame having a waste elimination opening formed therethrough; and an accordion fold elimination opening cover slidable between a withdrawn position allowing waste to pass through the waste elimination opening and an extended position blocking the waste elimination opening in a manner to provide support to a buttocks area of a user;

the open configuration raised support frame being sized to allow the elevated sling seat section of the wheel chair to be positioned over the bowl of a commode.

* * * * *